US005259790A

United States Patent [19]

Hayward

[11] Patent Number: 5,259,790

[45] Date of Patent: Nov. 9, 1993

[54] INSULATORS FOR COAXIAL CABLE CONNECTORS

[75] Inventor: Robert D. Hayward, Phoenix, Ariz.

[73] Assignee: Gilbert Engineering Co., Inc., Phoenix, Ariz.

[21] Appl. No.: 474,160

[22] Filed: Feb. 2, 1990

[51] Int. Cl.[5] ..... H01R 9/05

[52] U.S. Cl. ..... 439/578; 439/89

[58] Field of Search ..... 439/545, 578, 580, 546, 439/548, 562, 566, 705, 89

[56] References Cited

U.S. PATENT DOCUMENTS

| | | | |
|---|---|---|---|
| 2,379,942 | 7/1945 | Webber | 439/89 |
| 2,460,304 | 2/1949 | McGee et al. | 439/89 |
| 2,754,487 | 7/1956 | Carr et al. | 439/578 |
| 3,111,356 | 11/1963 | Mazzagatti et al. | 439/548 |
| 3,879,102 | 4/1975 | Horale | 439/89 |

*Primary Examiner*—Larry I. Schwartz
*Assistant Examiner*—Hien D. Vu
*Attorney, Agent, or Firm*—Don J. Flickinger; Jordan M. Meschkow; Robert A. Parsons

[57] ABSTRACT

Improved insulator configurations are provided for retarding corrosion of the central conductor pin of a coaxial cable connector. In a first embodiment of the invention, the distal end of the dielectric which surrounds the pin is provided with a domed protuberance which deflects liquid away from the pin. As a result, there is no surface tension to hold droplets of liquid at the distal end of the connector, and no chance of electrolytic bridging between the conductor pin and the outer body of the connector when the connector extends horizontally through the entry port of a electrical device. In a second embodiment, the dielectric is provided with a tubular extension portion which forms an insulator sheath around the central conductor pin, thus preventing bridging even when the connector is oriented vertically and the distal end of the outer body is submerged in liquid.

4 Claims, 1 Drawing Sheet

INSULATORS FOR COAXIAL CABLE CONNECTORS

BACKGROUND

1. Field of the Invention

This invention relates to cable transmission systems.

More particularly, the present invention relates to connectors of the type normally used to connect coaxial cables to equipment in environmentally sealed housings.

In a further and more specific aspect, the instant invention concerns coaxial cable connectors having improved insulators for preventing corrosion of the central conductor pins when moisture accumulates in the equipment housing.

2. Prior Art

The use of coaxial cable to transmit signals from a primary source, such as a central computer or an antenna, to a number of receivers such as computer terminals or television sets, is generally well known. In addition, coaxial cable may be used to couple the source and receivers to any number of intermediate auxiliary devices such as amplifiers, extenders and directional taps.

Most equipment used in conjunction with coaxial cable is contained within environmentally sealed housings having entry ports of standard dimensions. Typically, the cable is coupled to the housing by a connector having a tubular outer body which is configured to be matingly received in the entry port. The outer body of the connector encircles a central conductor pin which extends into a terminal within the housing to make an electrical connection with the equipment. The conductor pin is separated from the outer body by a non-compliant cylindrical dielectric, the distal end of which is conventionally recessed with respect to the distal end of the outer body.

In spite of the fact that most equipment housings are initially environmentally sealed, circumstances do arise in which it is necessary to open the housings and in which moisture is allowed to enter. This is particularly true of outdoor equipment which must be opened for repair during rain or snow storms. In addition, seals may become damaged after some period of time, or technicians may neglect to completely close the housing after troubleshooting or repair. As a result, equipment housings are frequently not as dry in practice as they should be in theory.

Moisture within the equipment housing causes gradual, generalized corrosion of the metallic parts of the connector and may eventually lead to complete failure of the connector. In addition to this generalized corrosion, more rapid, highly selective corrosion has been observed to occur at the base of the central conductor pin and along the inner circumference of the distal end of the outer body. Corrosion of the pin causes the pin to break into two pieces, causing an open circuit and completely stopping operations in the cable system. In some cases, complete failure of the pin will take place in as little as one month.

This extremely selective corrosion of the conductor pin has long puzzled connector designers, who have been unable to understand the failure mechanism behind such corrosion and to prevent it from occurring. It has now been determined, however, that the primary cause of corrosion is moisture in the recessed area between the pin and the body of the connector, both of which are made of metal. Any condensate or other droplet of liquid which flows down the interior sides of the equipment housing and onto the recessed area will be retained there because of surface tension, even when the distal end of the connector is vertically oriented. Thus, the droplet will act as a bridge between the connector pin and the outer body, creating a complete electrolytic cell. When alternating current is supplied, metal at both electrodes of the cell will dissolve at a relatively rapid rate.

Because of the rapid corrosion of connector pins, technicians must frequently inspect the connectors and replace them when necessary. If not replaced in time, the connectors will fail completely, sometimes bringing an entire transmission system to a halt. The time spent inspecting and repairing systems as a result of faulty connectors, as well as the expense of producing and maintaining a large inventory of replacement connectors, represents an undue burden to all concerned, including the consumer.

It would be highly advantageous, therefore, to remedy the foregoing and other deficiencies inherent in the prior art.

Accordingly, it is an object of the present invention to provide an improved connector for securing a coaxial cable to a selected device.

Another object of the invention is the provision of means for retarding the corrosion of the central conductor pin of a coaxial cable connector.

And another object of the invention is to provide an insulator configured to prevent liquid from bridging the pin and outer body of a coaxial cable connector.

Still another object of this invention is the provision of a coaxial cable connector with an improved dielectric having a domed upper surface for preventing surface tension from retaining a water droplet between the pin and outer body of the connector, even when the distal end of the connector is vertically oriented.

Yet another object of the invention is to provide an insulator sheath for surrounding the central conductor pin of a coaxial connector to prevent liquid from bridging the pin and the outer body of the connector, even when the distal end of the body is submerged in liquid.

Yet still another object of the immediate invention is the provision of an improved coaxial cable connector configured to be received in an entry port of standard configuration and dimensions, with no need for modifications to the entry port.

And a further object of the invention is to provide new and novel insulators for coaxial cable connectors using conventional and readily available materials.

Still a further object of the invention is the provision of a new and novel coaxial cable connectors which are readily fabricated with pre-existing technology and machinery.

And still another object of the invention is to provide improved coaxial cable connectors which are conveniently field installed using traditional skills and tools.

Yet still a further object of the invention is the provision of a coaxial cable connector, according to the foregoing, which is relatively inexpensive and maintenance free.

SUMMARY OF THE INVENTION

Briefly, to achieve the desired objects of the invention in accordance with the preferred embodiments thereof, provided is a coaxial cable connector having a tubular outer body which encircles a central conductor pin. The body is separated from the pin by a cylindrical dielectric, the distal end of which is configured to prevent liquid from bridging the outer body and the central pin.

More specifically, in a first embodiment of the invention, designed particularly for applications in which the connector extends horizontally into the equipment housing and the distal end of the outer body is vertical, the distal end of the dielectric is dome-shaped. Thus, any droplet of water which strikes the body will be deflected away from the central pin. No surface tension will be created to hold the droplet between the pin and the outer body, and no bridging will occur. Accordingly, selective corrosion at the base of the pin will be eliminated.

In a second embodiment of the invention, designed for applications in which the connector extends vertically into the housing and the connector body is entirely submerged in liquid, the dielectric is provided with a tubular extension portion which surrounds the central conductor pin, forming an insulator sheath. The length of the sheath is selected so that the distal end of the sheath is higher than the maximum tolerable level of water in the equipment housing, yet does not insulate the binding post where the electrical connection is made.

BRIEF DESCRIPTION OF THE DRAWINGS

The foregoing and further and more specific objects and advantages of the instant invention will become readily apparent to those skilled in the art from the following detailed description of the preferred embodiments thereof taken in conjunction with the drawings, in which.

DETAILED DESCRIPTION OF THE PREFERRED EMBODIMENTS

Figure 1:
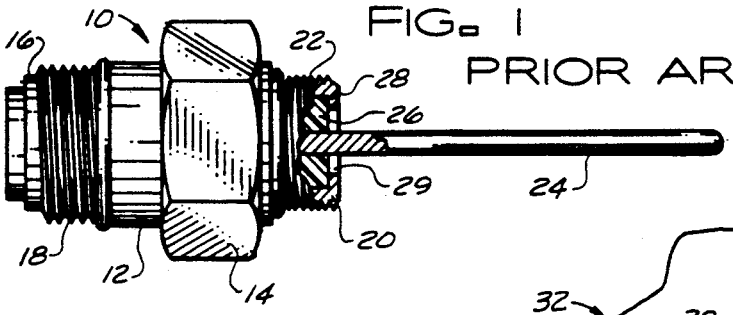
FIG. 1 PRIOR ART
FIG. 1 is a perspective view, partly broken away for purposes of illustration, of a conventional prior art connector illustrated herein for purposes of comparison.

Turning now to the drawings in which like reference numerals indicate corresponding elements throughout the several views, attention is first directed to FIG. 1 which illustrates a conventional prior art connector generally designated by the reference character 10.

Connector 10 includes a generally tubular outer body 12 fabricated of an electrically conductive material, usually a metal, such as aluminum or brass. A nut 14 is formed on an intermediate portion of the body 12 for facilitating rotation of the connector 10 when connecting it to a selected device. The body 12 includes a proximal end 16 provided with first fastening means, such as external threads 18, for securing the connector 10 to the end of a coaxial cable (not shown), and a distal end 20 provided with second fastening means, such as external threads 22, for securing the connector 10 to the device.

A central conductor pin 24 is carried coaxially within outer body 12. A non-compliant, cylindrical dielectric extends between the central conductor pin 24 and the outer body 12. The dielectric 26 is restrained from forward movement in the outer body 12 by an annular flange 28 extending inwardly from distal end 20 of the outer body 12. The space between annular flange 28 and central conductor pin 24 defines a recess or well 29 in which small droplets of moisture may be retained due to surface tension. Such moisture may act as a bridge between the conductor pin 24 and the outer body 12, thus creating an electrolytic cell which causes selective corrosion of the base of the pin 24 and portions of annular flange 28.

Figure 2:
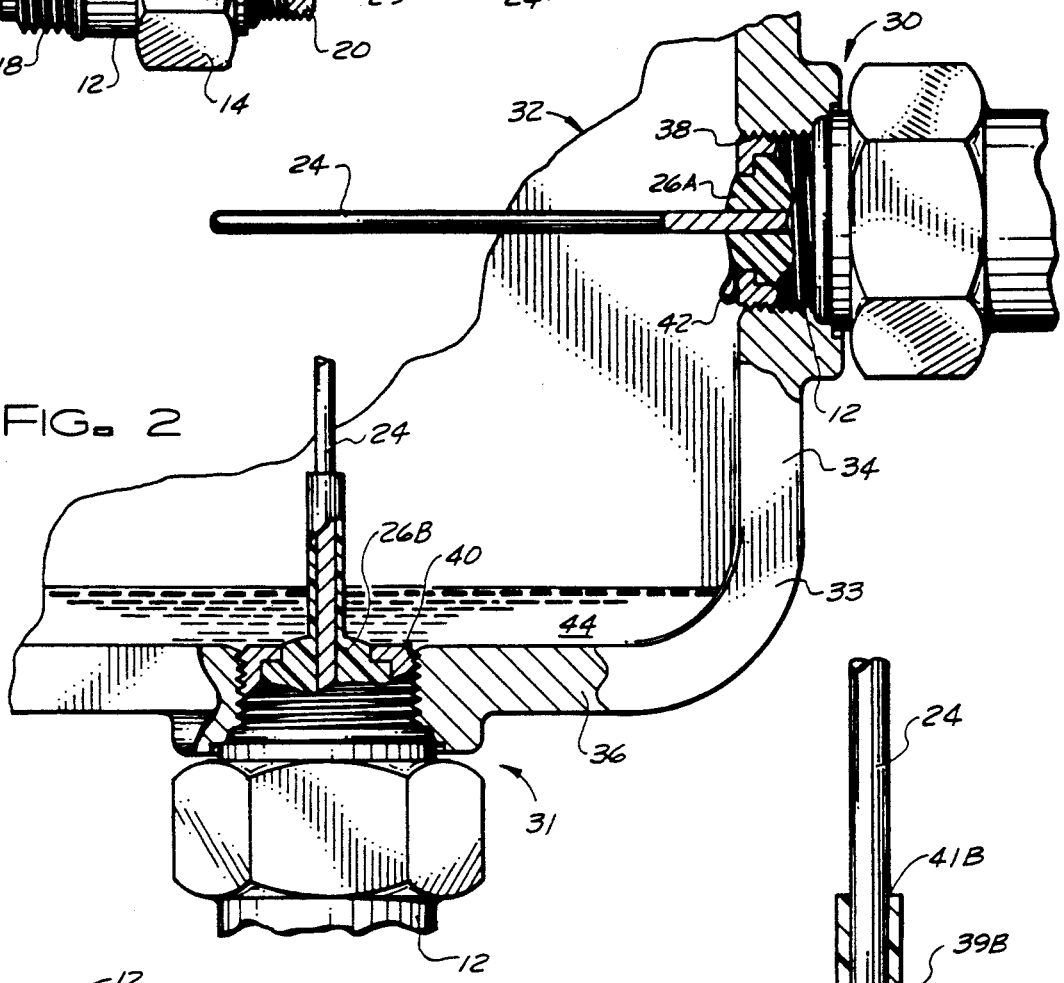
FIG. 2 is a perspective view, partly broken away, showing an equipment housing into which connectors according to both embodiments of the present invention have been inserted.

FIG. 2 illustrates a pair of connectors 30, 31 according to two different embodiments of the instant invention, each of which overcomes the aforementioned problem of bridging between the central conductor pin and the outer body of the connector. The connectors 30, 31 are coupled to an electrical device 32 having a conventional housing 33 including at least one vertical wall 34 and at least one horizontal wall 36. A first entry port 38, of standard configuration and dimensions, is formed in vertical wall 34, and a second entry port 40, also standard, is formed in horizontal wall 36. Although initially environmentally sealed, the housing 33 has been opened at least once, allowing a small amount of condensate 42 to form on vertical wall 34 and a larger pool 44 of moisture to accumulate on bottom horizontal wall 36.

Figure 3:
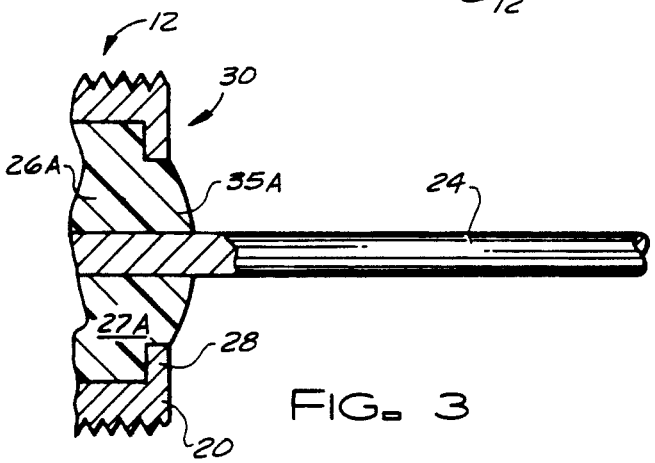
FIG. 3 is a fragmentary sectional view showing a connector according to a first embodiment of the invention.

Connector 30 according to the first embodiment of the invention, shown on the upper right of FIG. 2 and in greater detail in FIG. 3, has been designed specifically to remedy the problem caused by condensate 42 on vertical wall 34. Tubular outer body 12 and central conductor pin 24 of connector 30 are identical in structure to their similarly identified counterparts on the prior art connector 10 illustrated in FIG. 1. However, the design of dielectric 26A is novel. Specifically, distal end 27A of dielectric 26A has been provided with a generally dome-shaped protuberance 35A which projects through the opening defined by annular flange 28A and extends beyond the distal end 20 of outer body 12. The convex configuration of this protuberance causes any condensate 42 travelling down vertical wall 34 of housing 33 to be deflected radially outwardly, away from central conductor pin 24. Thus, no surface tension is created to hold the condensate in place, and no bridge is formed between central conductor pin 24 and outer body 12.

Figure 4:
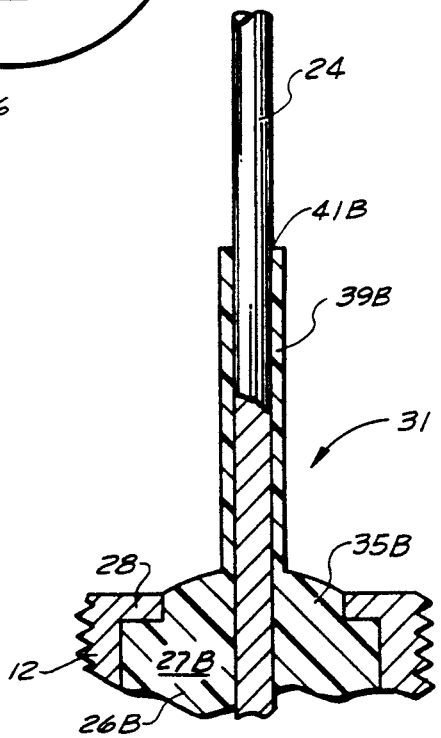
FIG. 4 is a fragmentary sectional view showing a connector according to a second embodiment of the invention.

Connector 30 is protected from corrosion of the type described above only in circumstances where the distal end 20 of outer body outer body 12 is located above the level of any pool of liquid 44 which may have accumulated in the bottom of housing 33. Clearly, the domed surface 35A of dielectric 26A would be insufficient to prevent bridging when the distal end 20 of outer body 12 is entirely submerged in liquid. Such a situation may occur when the connector is inserted vertically through a horizontal entry port 40 at the lowest point in the housing, as shown on the lower left side of FIG. 2. Accordingly, a second embodiment of the invention has been devised for use in arrangements of this type. This second embodiment is represented by connector 31 in FIGS. 2 and 4. Turning specifically to FIG. 4, connector 31 includes a tubular outer body 12 and a central conductor pin 24, which are identical to the outer body 12 and conductor pin 24 of the prior art connector 31 shown in FIG. 1. Dielectric 26B, like dielectric 26A of connector 30, has a domed protuberance 35B extending from its distal end through the opening formed by annular flange 28 of tubular body 12. A tubular extension portion 39B projects axially from the apex of protuberance 35B, forming an insulating sheath which shrouds the central conductor pin 24. As a result, no bridging will occur.

Extension portion 39B should be integrally formed with dielectric 26B and must be free of any seams or joints which would allow moisture to reach between central conductor pin 24 and outer body 12. The length of extension portion 39B is selected so that the sheath extends as far as possible into entry port 40, while still leaving the tip of the central conductor pin 24 uninsulated to act as a binding post for making the electrical connection. The distal end 41B of the extension portion 39B should be above the maximum tolerable level of moisture in housing 33. Any moisture above this level would certainly be noticed by technicians and removed before significant corrosion of the central conductor pin 24 could occur.

Various modifications and variations to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A cable-to-housing connector for mechanically and electrically connecting the end of a coaxial cable to a housing enclosing a space subject to accumulation of moisture, having an entry port, said connector comprising:

a tubular outer body formed of electrically conductive material, said outer body having a proximal end and a distal end;

first fastening means formed on the proximal end of said outer body for securing said outer body to the end of said cable;

second fastening means on the distal end of said outer body for securing said outer body to the entry port of said housing adjacent said space;

a central conductor pin spaced inwardly of and coaxial with said outer body, said conductor pin having a distal end projecting beyond the distal end of said outer body and through said space; and a non-complaint dielectric disposed between said outer body and said central conductor pin, said dielectric having a substantially dome-shaped distal end protruding beyond the distal end of said outer body into and surrounded by said space for deflecting moisture, collecting in said space, away from said central conductor pin toward the outer circumference of said tubular outer body to prevent the accumulation of moisture between said outer body and said central conductor pin and a tubular extension portion extending from the apex of said dome-shaped distal end, said extension portion forming an insulator sheath surrounding said conductor pin.

2. A connector according to claim 1, wherein the apex of said distal end of said dielectric is located beneath the distal end of said conductor pin.

3. In a cable-to-housing connector for mechanically and electrically connecting the end of a coaxial cable to a housing having an entry port, which connector includes a tubular outer body formed of electrically conductive material, said outer body having a proximal end and a distal end, first fastening means formed on the proximal end of said outer body for securing said outer body to the end of said cable, second fastening means on the distal end of said outer body for securing said outer body to the entry port of said housing, a central conductor pin spaced inwardly of and coaxial with said outer body, said conductor pin having a distal end projecting beyond the distal end of said outer body and extending into the interior of said housing for electrical connection therewith, and a non-compliant dielectric disposed between said outer body and said central conductor pin, said dielectric having a distal end, the improvement for preventing liquid bridging between said outer body and said central conductor pin when said housing is oriented such that said entry port is the lowest point of the device and said connector extends vertically through said entry port with the distal end of said outer body submerged in liquid, the level of said liquid being less than or equal to a predetermined maximum tolerable level, wherein said dielectric comprises:

a tubular extension portion projecting axially from the distal end of said dielectric to form an insulator sheath surrounding said conductor pin, said extension portion having a distal end located above said predetermined maximum tolerable level and below the distal end of said conductor pin; and a domed upper surface which slopes downwardly from a maximum height at the base of said tubular member to a minimum height at the outer perimeter of said dielectric.

4. The improvement of claim 3, wherein said dielectric and said tubular extension portion are integrally formed.

* * * * *

UNITED STATES PATENT AND TRADEMARK OFFICE

CERTIFICATE OF CORRECTION

PATENT NO. : 5,259,790

DATED : 9 November 1993

INVENTOR(S) : Robert D. Hayward

It is certified that error appears in the above-identified patent and that said Letters Patent is hereby corrected as shown below:

Column 5, Line 50 (Claim 1), "non-complaint" should be --non-compliant--.

Signed and Sealed this

Twelfth Day of July, 1994

*Attest:*

*Attesting Officer*

BRUCE LEHMAN

*Commissioner of Patents and Trademarks*